SR
10/22/85 OR 4,548,596

United States Patent [19]
Sutton, III et al.

[11] Patent Number: 4,548,596
[45] Date of Patent: Oct. 22, 1985

[54] CENTRIFUGE ROTOR AND METHOD OF ASSEMBLY

[75] Inventors: John H. Sutton, III, Belmont; Steven J. Chulay, San Mateo, both of Calif.

[73] Assignee: Beckman Instruments, Inc., Fullerton, Calif.

[21] Appl. No.: 616,643

[22] Filed: Jun. 4, 1984

[51] Int. Cl.[4] ..... B04B 5/02
[52] U.S. Cl. ..... 494/20
[58] Field of Search ..... 494/20, 16, 17, 18

[56] References Cited

U.S. PATENT DOCUMENTS 3,454,217 7/1969 Harbott ..... 494/20
4,236,666 12/1980 Aeschlimann ..... 494/20
4,435,168 3/1984 Kennedy ..... 494/20

FOREIGN PATENT DOCUMENTS 925817 3/1955 Fed. Rep. of Germany ..... 494/20

*Primary Examiner*—Robert W. Jenkins
*Attorney, Agent, or Firm*—W. H. May; P. R. Harder; L. D. Rish

[57] ABSTRACT

A centrifuge rotor is claimed which comprises a rotor having a plurality of radially extending arms, having a construction to matably receive a pin structure within a recess formed in the upper surface of the rotor, to support the pin structure against loads generated by centrifugal force without stressing a fastener. In assembly, the pin structures permanently mount trunnions for receiving a sample container, for pivotal movement, in a manner such that the trunnion and sample container cooperate to resist stresses and deformation caused by centrifugal loads.

10 Claims, 8 Drawing Figures

FIG. 7
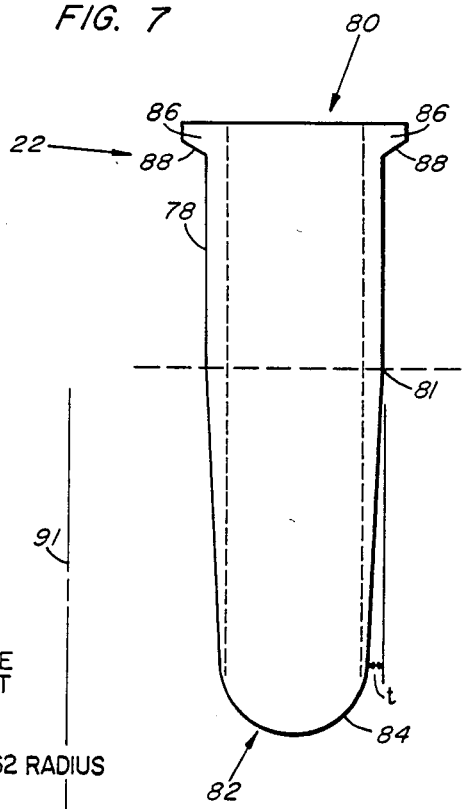
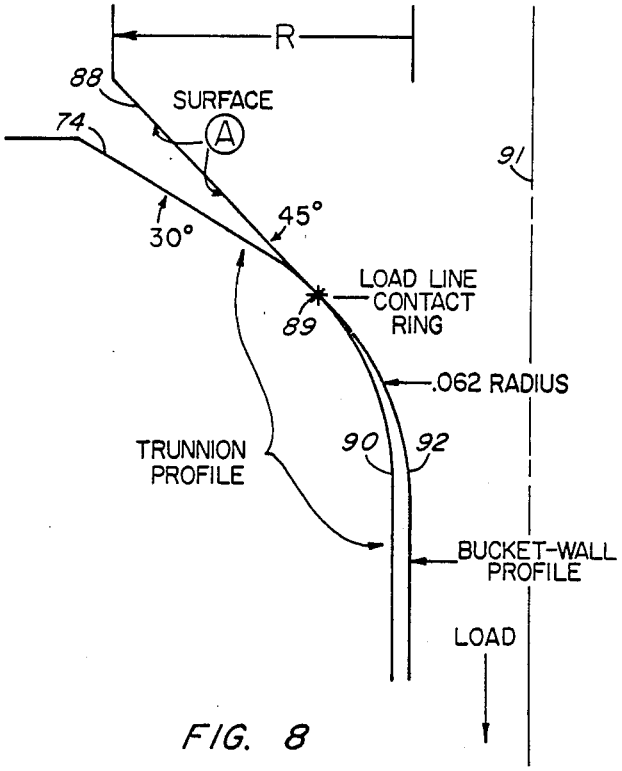
FIG. 8

CENTRIFUGE ROTOR AND METHOD OF ASSEMBLY

TECHNICAL FIELD

The present invention pertains to rotors used in centrifuges for supporting a sample container and a sample, and spinning the sample in the container to generate a high centrifugal force field on the sample material, and in particular to an inventive rotor design and structure which includes permanently held, pivotable rings into which a sample-carrying member may be placed for support during centrifuge operation.

BACKGROUND ART

Prior art centrifuge rotors have incorporated designs which have permanently mounted rings, interspaced and pivotable between radial arms extending from the turning axis of a centrifuge rotor. Generally, the rings provide a means for supporting a sample container such as a test tube, in a generally vertical free-hanging position during non-operative periods of the centrifuge and for allowing the test tube to swing to a generally horizontal position under an applied centrifugal force field generated when the rotor is turned at high rotational speed. The extending arms supporting a pivotable ring are generally formed radially outwardly from a yoke portion central to the rotor. Pin means are provided, either extending outwardly from the ring into receiving bores formed in the extending arms or vice versa, from the arms to bores in the ring.

Prior art designs as described above, are limited in their ability to survive catastrophic failure under increasing centrifugal forces generally by the design of the extending arms or the pivotable connection between the arms and the ring. When the support pin for mounting a ring is formed as an integral part of either the ring or the extending arm, stresses are caused whenever there is a surface irregularity by application of the high centrifugal forces, resulting in an initial cracking and, finally, destructive failure of either the arm or the ring. Attempts to strengthen these parts to broaden the magnitude of force under which these parts can survive have met with limited success, generally due to design limitations on the size of the parts. For instance, sizing the extending arm in larger proportions or making the arm out of a stronger material such as high-strength steel, which is heavier in weight, leads to even greater strength requirements due to the increased mass of the part which is affected by the centrifugal force field. Thus, simply increasing the size or using a stronger but heavier material in forming the extending arms, or any of the outwardly extended part such as the rings, does not assure increased performance capability permitting the rotor to generate higher centrifugal force fields without failure.

SUMMARY OF THE INVENTION

The present invention is a centrifuge rotor assembly comprising a rotor having a plurality of extending arms, each of which provides an upright shoulder to receive a pin structure for supporting a trunnion, or in other terms, a sample container receiving ring, between adjacent arms. The trunnion is pivotable about a generally horizontal axis perpendicular to a radial line extending from the rotational center of the rotor. The pivotal axis is defined by adjacent pin structures. Each trunnion comprises a central opening adapted to receive a sample container therein from either end of the opening.

The rotor assembly provides an offset pivotal mounting for the trunnion and mated sample container, as is described in co-pending Application Ser. No. 616,644, filed on June 4, 1984 by John H. Sutton, III. The two-piece design of the rotor arm-pin structure assembly permits these elements to be constructed of differing type materials, each of which are advantageous for their particular use.

An L-shaped construction of each of the rotor arms provides a shoulder and floor surface against which a pin structure is received to support loads exerted on the pin structure by a trunnion-sample container assembly. Through this design a small pin structure of high-strength material may be provided which is isolated from the rotor arm relative to stresses caused through loads on the pin. The rotor may be constructed of a different lighter material to reduce loading from centrifugal forces.

Further, the pin structure is supported on the rotor without stressing a fastener when loads are applied to the pin structure from the trunnion-sample containers by centrifugal force. Fastener non-loading is accomplished by providing the mating constructions of the rotor arm and pin structures.

Trunnions or receiving rings are permanently mounted between adjacent pin structures for pivotal movement along a radial of the rotor. Each trunnion is designed to receive a complementary sample container through either end of the opening formed therethrough. The loading contact between the trunnion and a sample container is designed to minimize deformations in the combined components, while providing minimum mass upon which the generated centrifugal force field may act. The trunnion preferably comprises an oval circumferential configuration around a longitudinal axis of the circular bore formed longitudinally therethrough, to form a ring-type structure with a cylindrical wall of varying wall thickness. A pair of opposing aligned and pin-receiving bores are formed through thickest wall sections of the trunnion along an axis perpendicular to the axis of the bore formed through the trunnion. Each end of the longitudinal bore formed through the trunnion is provided with a load-bearing surface to matably receive a sample container.

The sample container comprises a tubular structure having a rim portion formed adjacent its open end. The tubular structure tapers from a mid-point of its body toward the closed end. The outer diameter of the sample container is sized for a tight-sliding fit within the longitudinal bore of the trunnion, so that deflections of the trunnion caused by stresses from a high centrifugal force field generated will be counteracted by the support of the sample container within the trunnion bore. The underlying surface of the rim portion adjacent the open end of the sample container is shaped to provide load contact with a mating trunnion surface about a circular position on the underside of the rim. The mating surfaces provide load contact as close as possible to the axial center of the tubular body of the sample container, without permitting the container to become seized within the trunnion. This is accomplished by providing differing angular surfaces surrounding the opening of the trunnion bore and on the under side of the sample container rim, such that contact between the elements is as close to the center of the trunnion bore as possible. The sample container is provided with a radius between the under side of the rim and the side wall of its tubular body to reduce localized stress at the surface transition. This radius is complimented by a corresponding radius formed between the transition from the receiving surface to the bore sidewall of the trunnion.

DETAILED DESCRIPTION OF THE DRAWINGS

FIG. 7 is a side view of a sample container.

FIG. 8 is a schematic representing the contact surfaces of the trunnion and sample container as assembled.

DESCRIPTION OF THE PREFERRED EMBODIMENT

Figure 1:
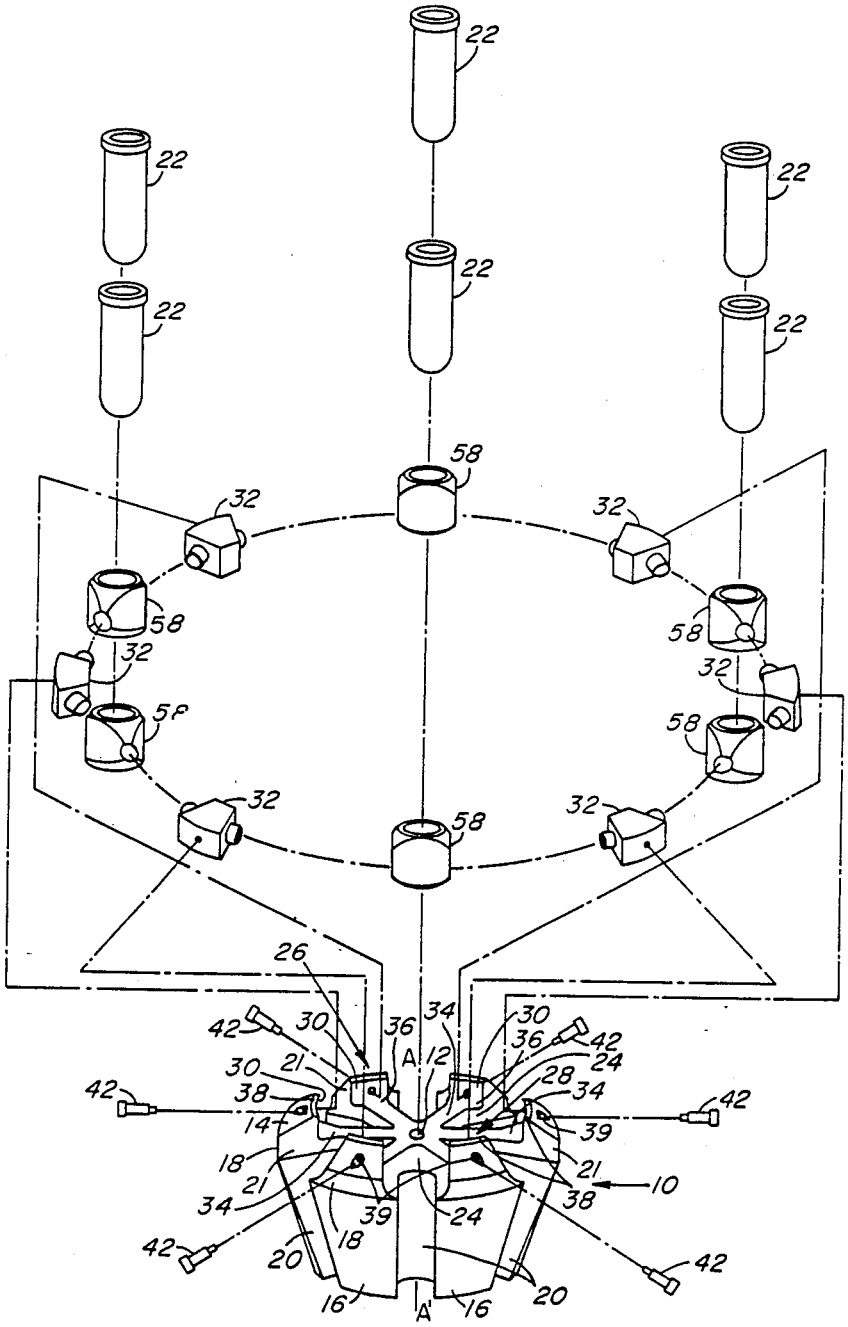
FIG. 1 is an exploded perspective view showing the centrifuge rotor and two sample container-assemblies.
Figure 2:
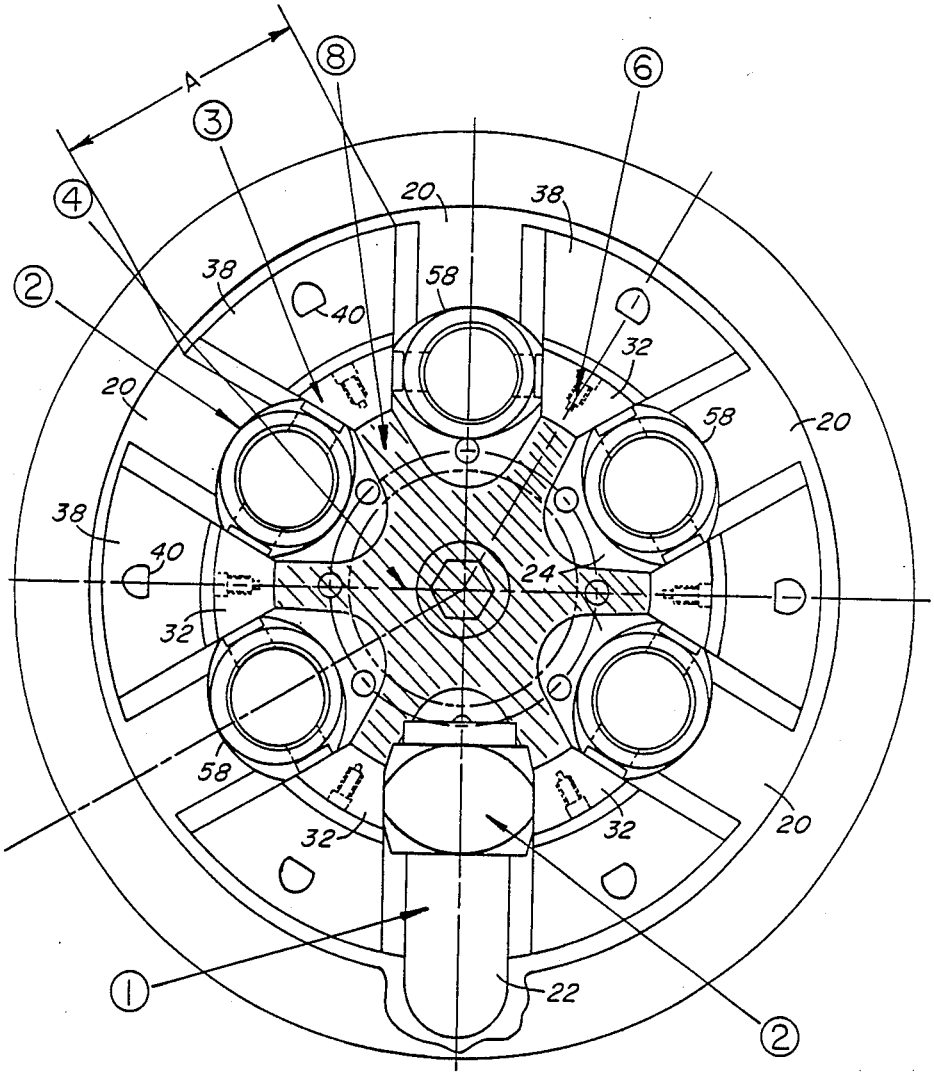
FIG. 2 is a top view of the centrifuge rotor.

The centrifuge rotor assembly presented herein comprises a plurality of pin structures; a plurality of trunnions or, as may be referred, sample container receiving rings, and, a plurality of sample containers, and may be generally described with reference to FIGS. 1 and 2. A centrifuge rotor 10 is provided which has a shape that may be generally described as cylindrical with a bevel portion machined around the circumference of each longitudinal end. The axis rotation of the rotor A—A' is centrally positioned through a bore 12 for receiving a shaft (not shown) upon which the rotor is mounted for rotation. The upper bevel portion, 14, is formed with greater angle relative to the rotational axis A—A' than the lower bevel portion 16. The lower bevel portion 16 extends around a much larger circumferential surface than does upper bevel portion 14, such that the ratio between their axial length is approximately four to one, though other configurations are considered appropriate by the inventor in providing maximally reduced circumferential weight without reducing radial strength of the rotor. A flat circumferential surface characteristic of the outside of the cylinder from which the rotor 10 is formed, remains at a central location 18 of the rotor periphery between the edges of the upper and lower bevels 14 and 16, respectively. The flat circumferential portion 18 defines a surface area through which the radial plane of maximal strength and highest stress exists in the rotor structure when the rotor is spun at high rotational speed to generate a centrifugal force field.

A plurality of longitudinal recesses 20 are formed into the outer surface of rotor structure 10 parallel with the axis of rotation and inwardly along a radial line, for receiving sample containers 22. Each of the recesses 20 are identically shaped and equally spaced from one another, and from rotational axis A—A' to form a symmetrical recess 20 pattern around the rotor. The equally separated recesses 20 define a plurality of radially extending portions of the rotor 10, referred to as arms 21. Each adjacent pair of arms 21 provides a supporting structure for a sample container. The number of recesses 20 formed into the rotor 10 may be of any selected number greater than one; however, in the preferred embodiment, six grooves have been selected due to the symmetrical size relationship resulting therefrom. Thus, when six grooves are formed radially into the rotor, six radially projecting arms are defined, each adjacent pair of arms 21 providing support for an interposed container 22.

A second plurality of recesses 24 is formed around the upper end of each of the recesses 20, and radial inwardly, to provide clearance for sample containers 22 and their pivotal mounts as they move from a vertical to a horizontal position when the rotor increases rotational speed and centrifugal force is applied.

The upper surface 26 of the rotor 10 has a circular recess 28 formed therein coaxial with the axis of rotation A—A' and of a diameter smaller than that of the rotor and surface diameter defined by the outer edge of upper bevel 4.

The side of the recess 28 forms a vertical curvilinear surface 30, inwardly directed, on each arm 21 of the rotor 10.

The inwardly directed surfaces 30 on each of the radial arms 21 provides a vertical radial support for the elements, such as pin structures 32, which mount the sample containers to the rotor. The floor 34 of the circular recess 28 is flat and exists in a plane perpendicular to the axis of rotation of the rotor. The floor area 34 adjacent each arm surface 30 provides a horizontal support for each mounting element such as pin structure 32. The circumferential boundary of the floor 34 of the recess 28, where the floor surface meets the inwardly directed surface 30 formed on each arm 21, is provided with a radius or curved portion at points 36 to provide stress relief in this area when loads are applied to upwardly directed portions 38 of each arm 21 through surfaces 30. The stress relief at points 36 reduces the chance of cracking or structural failure when high loads are applied to the upper portion 38 of each arm 21.

A small bore 39 is centrally formed through the upper portion 38 of each arm 21 and directed radially towards the center of the rotor 10. The outward end of each bore 40 is provided with a counterbore to form a surface against which a fastener 42 may bear to pull an mounting element, such as pin structure 32, tightly against the inwardly directed surface 30 to hold the element in position. Because the upper portion 38 of each arm 21 bears all outwardly radial loads due to a centrifugal force field, the fasteners 40 remain unstressed other than to hold the mounting elements pin structures 32 in position.

A pin structure 32 is provided to mate with each arm 21 and provide a pair of opposing mounting pins 44 to extend into each of the longitudinal recesses 20 formed into the rotor 10. The pin structure 32 can be described with reference to FIGS. 3 and 4.

Figure 3:
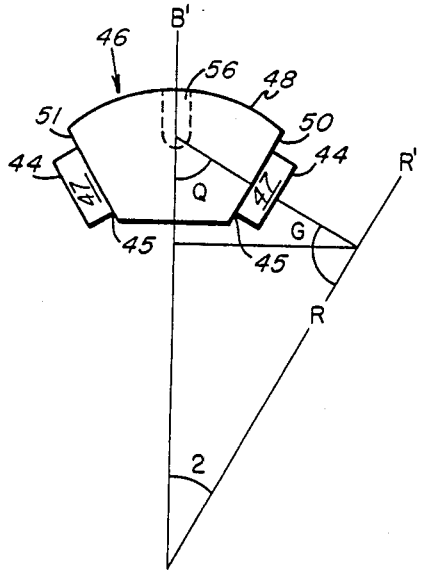
FIG. 3 is a top view of a pin structure.

Referring first to FIG. 3, viewing the pin structure 32 from above, the outer side 46 of the pin structure 32 comprises a slightly curved surface 48 which is adapted to mate with the inwardly directed curvilinear surface 30 on each rotor arm 21. The pair of pins 44 are generally cylindrically shaped and are directed laterally outwardly from the end sides 50 and 51, respectively, of the pin structure 32 with an angular relationship relative to the radial line which centrally intersects the pin structure. The angle $\phi$ which the pins 44 are directed relative to a central radial line B—B' through the arm 21 and pin structure 32 when assembled, is determined by the number of sample containers the rotor 10 is designed to carry. The number of longitudinal recesses 20, and the location of the pin structure 32 on the rotor 10, i.e. the radial line B—B' on which the pin structure 32 is positioned, determines the relationship, such that each outwardly extending pin 44 provides a pivotal axis perpendicular to the radial line R—R′ along which a sample container may swing. The angle $\phi$ which the pin axis 44 forms with the radial B—B′ on which the pin structure 32 lies can be determined from the following equation:

$$\phi+\theta+\alpha=180^\circ \qquad \text{Eq. 1}$$

where, $\phi$=angle between pin pivotal axis and radial B—B′ through pin structure $\theta$=angle between pin pivotal axis and radial R—R′ along which container swings; equals 90°

$\alpha$=angle between radials B—B′ and R—R′

Since $\theta$ always must equal 90° the equation may be reduced to $$\phi=90^\circ-\alpha. \qquad \text{Eq. 2}$$

Thus, for a six-container configuration as shown, the angle between rotor arms 21 is 60°, which defines an angle of 30 degrees between the radial line B—B′, central to arm 32 and pin structure 32, and radial line R—R′ central to the sample container location, as indicated by angle $\alpha$. Since angle $\alpha=30$, $\phi$ may be determined from Equation 2 to be equal to 60°. The angle $\phi$ is selected such that pins 44 from adjacent pin structures 32 entering into the recess 20 space will be aligned and parallel to provide a pivotal mounting axis for a sample container. Each of the pins 44 is provided with a relief arm radius at location 45 where the pin surface 47 meets the pin structure body.

Figure 4:
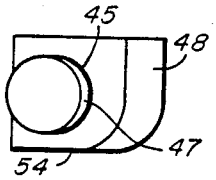
FIG. 4 is an end view of a pin structure.

Referring to FIG. 4, a lower portion of the outer side 46 of the pin structure 34 is provided with a curvature which equals the radius formed between the inwardly directed surfaces 30 and floor 34 of the circular recess 28 of the rotor, so that the pin structure 32 may be mated to the rotor arm 32 with the outward side 48 engaging the inward surface 30 and the bottom 54 engaging the floor 34. Mating the pin structure 32 with the rotor arm 21 in this manner permits the rotor 10 to absorb all outwardly directed forces generated against the pin structure 32 by a sample and a sample container when a centrifugal force field is generated by spinning the rotor. Thus, advantageously, there are no fastening elements necessary for the rotor arm 21 to support the pin structure 32.

A fastener 42 which is directed through the bore 39 formed in the rotor arm 21 is threaded into a threaded bore 56 formed in the outer side 48 of the pin structure 32 in assembly, to ensure only that the pin structure remains in correct location within the recess 28 formed in the upper surface of the rotor 10. The fastener 42 is not required to absorb any stresses or forces generated by centrifugal force effects on the rotor structure, sample container or its supporting elements.

The two-piece rotor-pin structure design described with reference to the above Figures, permits the rotor 10 to be made of a first material and the pin structure 32 to be made of a second material. For instance, the rotor 10 may be made of an aluminum material to reduce mass upon which centrifugal force acts when the rotor is spun at high speed. This force would be significant due to the large size and diameter of the rotor. The pin structure 32, however, may be made of a different material such as titanium which has a very high strength to weight ratio, though possesses too large a mass per volume characteristic to embody the entire rotor. Since the pin structure 32 is designed to be relatively small in size with the presented rotor assembly, the weight of the material of which it is made has small effect on the whole of the rotor structure and stronger materials for the pin structure may easily be used.

The design of the rotor-pin structure assembly further permits selection of lighter though less strong materials for the rotor 10, in that transfer of force generated on the pin structure is made to a relatively large, inwardly directed surface 30 formed on the rotor arm 21. This is permissible due to the large surface area bearing the force applied to the pin structure and due to the large portion of the rotor arm which bears the forces applied to the surface 30, as shown by dimension A in FIG. 2. The large surface area 30 allows large section sizing of the arm 21 and thus permits the rotor to be formed of materials which may not have as high strength without compromising rotor structure strength.

Figure 5:
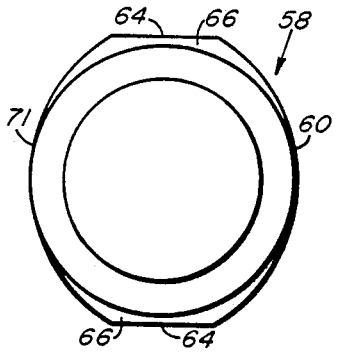
FIG. 5 is a top plan view of a trunnion.
Figure 6:
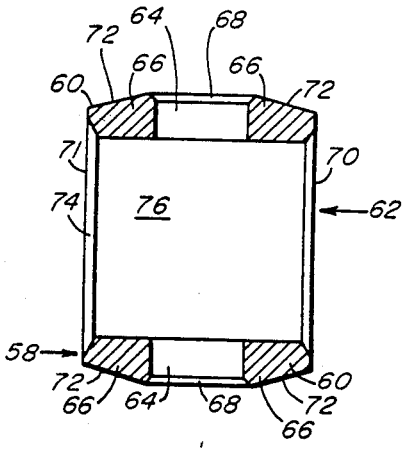
FIG. 6 is a cross-sectional view of a trunnion, with the section taken longitudinally through the axis through the pin-receiving bores.

A trunnion, or container receiving ring 58, is provided for pivotal engagement between each pair of pin structures 32 in the rotor assembly 10. The trunnion 58 may be described with reference to FIGS. 5 and 6. The trunnion 58 is a generally cylindrical member defined by a circular wall, generally indicated as 60, having a bore 62 formed coaxially through its body, to receive a sample container. A pair of pin-receiving bores 64 are formed through the side walls of the trunnion in opposing and aligned relation for receiving the mounting pins 44 of adjacent pin structures 32, for pivotal support of the trunnion 58 about a pivotal axis tangent to the radial line R—R′ of the rotor along which the trunnion with sample container should swing. The cylindrical body of the trunnion 58 has a generally uniform wall thickness, with expanded wall portions surrounding the pin bores 64 formed through the trunnion walls indicated at 66, such that a cross-section taken generally through the pin bores 64 in the trunnion body would depict a generally oval circumferential shape. The increased wall thickness surrounding the pin bores at 66 provides additional strength for the local wall structure surrounding the bores 64. The outer edges 68 of the pin bores 64 are chamfered to provide clearance for the radius formed between the mounting pin 44 at 45 and the pin structure body.

The trunnion body 58 is generally tapered along the expanded wall sides toward each of its ends 70 and 71, respectively, from above and below the pin bores 64, as indicated at 72. The tapers 72 reduce weight of the trunnion body, and result in each ends 70 and 71 of the trunnion body having a circular shape. The circular end surfaces of the trunnion 58 are provided with a wide chamfer 74 adjacent the container receiving bore 62 on each end 70 and 71. The chamfer 74 is radiused into the interior wall 76 of the trunnion bore 62. Preferably, the chamfer 74 is formed with a substantially 30-degree angle relative to the central axis of the pin bores 64. The chamfer and radius leading into the bore interior provide a loading surface against which a sample container can bear, without seizure, as will be described following.

The trunnion 38 is preferably constructed of high strength aluminum material to reduce mass from which centrifugal force can act. The interior and exterior trunnion surfaces have no hard or protective coatings applied, such as anodizing. This assures that the surfaces remain free of localized stresses which can cause cracking when a high centrifugal force field is applied.

A sample container 22 which is received within the trunnion is shown in FIG. 7. The sample container comprises a generally tubular shaped body 78.

The upper portion of the body 78, near the opening 80, is generally cylindrical in shape. The lower portion of the body 78 near the closed end 82 tapers circumferentially from a mid-portion 81 of the tubular body to the beginning of the ball-shaped bottom 84 as shown by exaggerated dimension t. The taper changes the outer diameter of the tube by a slight amount through slightly decreasing the wall section thickness of the tubular body for weight savings, preferably no more than 0.004".

The top of the tubular body 78 adjacent to the opening 80 is provided with an outwardly directed rim 86 around the circumference of the body. The undersurface 88 of the rim 86 is designed to provide a mating surface for contact with the loading surface of the trunnion 58, ie., the chamfer 74 surrounding the interior bore 64 of the trunnion 58. The undersurface of the rim 86 is provided with a beveled surface, preferably having 45 degrees angular relation with the central longitudinal axis of the container 22. With the rim under surface 88 having a 45-degree bevel and the trunnion loading surface 74 having a 30-degree bevel, when the container 22 is placed within the interior bore 64 of the trunnion 58, the respective surfaces of the container and trunnion will form a contact ring 89 which is as small in diameter and as near the coaxial center 91 of the trunnion and container as possible. This relationship can be visualized with reference to FIG. 8, where the trunnion profile 90 and the sample container profile 92 are shown in mating relationship. Providing a minimal diameter contact ring assures minimized bending stresses in the side wall of the sample container 22 as would be caused through lever arm effect when the radially extended rim 86 of the container 22 is loaded through centrifugal force.

Additionally, the outer diameter of the upper cylindrical porion of the sample container 22 is sized to have a tight slip fit with the interior bore 64 of the trunnion 58. Preferably, a clearance of 0.002 to 0.004 inches is provided. This precision sizing permits the interior wall 76 of the trunnion 58 to bear against the body 78 of the container 22 for support as the trunnion body distorts from application of high centrifugal forces. Thus, the container and trunnion in assembly coact to strengthen each other and the pivotal mounting construction.

The sample container 22 is preferably constructed of aluminum material, having a nominal wall thickness of 0.065 inches. The container 22 is also preferably coated with a hard protective coating, such as anondizing, to improve wear characteristics of the container through repetitive insertions and removals of the container into and from the trunnion 58.

With the above discussed construction of the centrifuge rotor, assembly of the rotor elements may be easily accomplished. With regard to the six sample rotor described, and with reference to FIG. 1, fixed pin structures 32 are assembled in circular relationship with six trunnions 58, each trunnion 58 interspaced between a pair of pin structures 32 and receiving a pin 44 from each of the pin structures into one of its pin-receiving bores 64. The trunnion-pin structure assembly is held together and placed into the circular recess 28 formed in the upper surface of the rotor 10, with each of the trunnions positioned in alignment with a longitudinal recess 20 formed into the periphery of the rotor body. The trunnion-pin structure assembly is rotated within the recess 28 to align the threaded bores 56 of each of the pin structures 32 with a bore 39 through the rotor arm 21. Threaded fasteners 42 are inserted through the bores 39 and screwed into the pin structures 32 to hold the structures in position and permanently mount a plurality of trunnions 58 to the rotor 10. Since the trunnions 58 are designed to receive a sample container 22 from either end 70 or 71, the rotor assembly is prepared to receive a sample container 22 by simply vertically aligning the bore 62 of each trunnion 58.

We claim:

1. A centrifuge rotor comprising:

a rotor body having a plurality of longitudinal recesses formed into the peripheral surface of said rotor to receive sample containers, said recesses defining a plurality of extending radial arms, and having a latitudinal recess formed in the upper surface of said rotor body defining a substantially vertical, inwardly directed, support shoulder in the upper surface of each arm;

and a pin structure secured to said rotor by fastening means and matably shaped with said support shoulder along the upper surface of each arm of said rotor for assembly on said rotor to provide a pivotal mounting for a sample container which provides radial support against outward forces applied to said sample containers without stressing the fastening means.

2. The centrifuge rotor claimed in claim 1 additionally comprising a trunnion for receiving a sample container permanently mounted in assembly of said rotor, for pivotal movement along a radial line of said rotor.

3. The centrifuge rotor assembly claimed in claim 2 additionally comprising a sample container for matable insertion within a trunnion of said rotor assembly, said container and trunnion in assembly providing cooperating structural support against centrifugal loads placed on the pivotal mounting of said rotor for said sample container.

4. The rotor assembly of claim 3 wherein said trunnion provides a contact surface having a first angular relationship with a central longitudinal axis thereof, and said sample container providing a contact surface with a second dissimilar angular surface with a central axis thereof.

5. The centrifuge rotor of claim 1 wherein said latitudinal recess is a circular recess formed in an upper surface of said rotor and further defines a floor surface, the circular recess and floor surface matably receiving an outer edge of said pin structure against said inwardly directed support shoulder; and a bottom surface of said pin structure seated against said inwardly directed support shoulder, said bottom surface of said pin structure also seated against said floor surface to support said pin structure against centrifugal loads in the presence of a centrifugal force field.

6. A centrifuge rotor assembly, comprising:

a rotor yoke having a plurality of radially extending arms, the peripheral surface of the rotor yoke formed to define at least one longitudinal recess between each of the arms for receiving sample containers;

said rotor yoke further having a recessed upper surface that is coaxial with the axis of rotation of the rotor yoke, the upper surface defining, in each of the radially extending arms, a curvilinear inwardly directed support surface which is substantially parallel to the longitudinal recesses, so that the upper surface forms a substantially L-shaped surface in each of the radially extending arms;

a plurality of pin structures, each pin structure shaped to mate with the support surface of each radially extending arm, the pin structure having a mounting pin extending into each longitudinal recess formed between each of said radially extending arms;

each pin structure mounted upon the support surface of a radially extending arm, for mating with the support surface;

a plurality of trunnion rings, each ring having a set of oppositely disposed bores defined along their outer surfaces, so that each trunnion ring may be permanently mounted between opposing pin structures of adjacent radially extending arms of the rotor yoke.

7. The centrifuge rotor assembly of claim 6 wherein the rotor yoke is of a light weight first material and the pin structures are of a massive and strong second material.

8. The centrifuge assembly of claim 7 wherein the rotor yoke is of aluminum and the pin structures are of titanium.

9. The centrifuge rotor assembly of claim 6 wherein the pin structure comprises a slightly curved surface which is adapted to mate with the curvilinear inwardly directed support surface on each of the rotor arms;

the pin structure having an outer surface that has a curvature that is a function of the circular recess of said rotor yoke and the inwardly directed support surfaces of each arm, so that the pin structures may be mated to each of the rotor arms to absorb all the outwardly directed forces generated by a sample and sample container when a centrifugal force field is generated by spinning said rotor yoke;

each of the pin structures being fastened to each of the rotor arms through a radially directed bore through the rotor arm and the pin structure by a fastening means which is not required to absorb centrifugal forces effecting the rotor yoke structure and the sample containers.

10. The centrifuge rotor assembly of claim 6 wherein each of the trunnion rings comprises:

a generally cylindrical body which defines wide walls and a central bore coaxially through the trunnion ring for receiving sample containers;

a pair of pin-receiving bores formed through the side walls of the trunnion in an opposing and aligned relationship;

expanded wall portions surrounding the pin-receiving bores for additional strength, the trunnion body being tapered along said expanded walls forming a pair of circular end surfaces each with a wide chamfer adjacent the central bore, providing a loading surface for the sample container of minimum contact and stress between trunnion and container.

* * * * *